US010465629B2

(12) United States Patent
Blom

(10) Patent No.: US 10,465,629 B2
(45) Date of Patent: Nov. 5, 2019

(54) INTERNAL COMBUSTION ENGINE HAVING PISTON WITH DEFLECTOR CHANNELS AND COMPLEMENTARY CYLINDER HEAD

(71) Applicant: Quest Engines, LLC, Coopersburg, PA (US)

(72) Inventor: Roy A. Blom, Coopersburg, PA (US)

(73) Assignee: QUEST ENGINES, LLC

( * ) Notice: Subject to any disclaimer, the term of this patent is extended or adjusted under 35 U.S.C. 154(b) by 0 days.

(21) Appl. No.: 15/903,636

(22) Filed: Feb. 23, 2018

(65) Prior Publication Data

US 2018/0283314 A1 Oct. 4, 2018

Related U.S. Application Data

(60) Provisional application No. 62/479,013, filed on Mar. 30, 2017.

(51) Int. Cl.

| | |
|---|---|
| ***F02F 3/00*** | (2006.01) |
| ***F02B 23/06*** | (2006.01) |
| ***F02F 3/24*** | (2006.01) |

(52) U.S. Cl.
CPC ..... *F02F 3/24* (2013.01); *F02B 23/0678* (2013.01)

(58) Field of Classification Search
CPC ..... F02F 3/00; F02F 3/24; F16J 1/00; F16J 1/001; F02B 23/06
See application file for complete search history.

(56) References Cited

U.S. PATENT DOCUMENTS

| | | | | |
|---|---|---|---|---|
| 1,016,561 A | | 2/1912 | Grabler | |
| 1,046,359 A | | 12/1912 | Winton | |
| 1,329,559 A | | 2/1920 | Tesla | |
| 1,418,838 A | | 6/1922 | Setz | |
| 1,511,338 A | | 10/1924 | Cyril | |
| 1,527,166 A | | 2/1925 | Maurice | |
| 1,639,308 A | | 8/1927 | Orr | |
| 1,869,178 A | | 7/1932 | Thuras | |
| 1,891,326 A | * | 12/1932 | Head | F02B 23/00 123/671 |

(Continued)

FOREIGN PATENT DOCUMENTS

| | | |
|---|---|---|
| CN | 201526371 | 7/2010 |
| CN | 106321916 | 1/2017 |

(Continued)

OTHER PUBLICATIONS

Graunke, K. et al., "Dynamic Behavior of Labyrinth Seals in Oilfree Labyrinth-Piston Compressors" (1984). International Compressor Engineering Conference. Paper 425. http://docs.lib.purdue.edu/icec/425.

(Continued)

*Primary Examiner* — Grant Moubry
(74) *Attorney, Agent, or Firm* — Yohannan Law; David R Yohannan

(57) ABSTRACT

Cooperatively shaped piston and cylinder head arrangements for internal combustion engines are disclosed. The piston may have a domed head with one or more curved exhaust channels and inlet channels formed therein. The piston cylinder may have curved surfaces that are exact or close inverse or negative counterparts to the curved surfaces of all or part of the domed head, including the exhaust channels, and/or inlet channels formed on the piston.

20 Claims, 11 Drawing Sheets

(56) References Cited

U.S. PATENT DOCUMENTS 1,967,682 A 7/1934 Ochtman, Jr.
1,969,704 A 8/1934 D'Alton
2,025,297 A 12/1935 Meyers
2,224,475 A 12/1940 Evans
2,252,914 A 8/1941 Balton
2,283,567 A 5/1942 Barton
2,442,917 A 6/1948 Butterfield
2,451,271 A 10/1948 Balster
2,468,976 A 5/1949 Herreshoff
2,471,509 A 5/1949 Anderson
2,878,990 A 3/1950 Zurcher
2,644,433 A 7/1953 Anderson
2,761,516 A 9/1956 Vassilkovsky
2,766,839 A 10/1956 Baruch
2,898,894 A 8/1959 Holt
2,915,050 A 12/1959 Allred
2,956,738 A 10/1960 Rosenschold
2,977,943 A 4/1961 Lieberherr
2,979,046 A 4/1961 Hermann
3,033,184 A 5/1962 Jackson
3,035,879 A 5/1962 Jost
3,113,561 A 12/1963 Heintz
3,143,282 A 8/1964 McCrory
3,154,059 A 10/1964 Witzky
3,171,425 A 3/1965 Berlyn
3,275,057 A 9/1966 Trevor
3,399,008 A 8/1968 Farrell
3,409,410 A 11/1968 Spence
3,491,654 A 1/1970 Zurcher
3,534,771 A 10/1970 Everdam
3,621,821 A 11/1971 Jarnuszkiewicz
3,749,318 A 7/1973 Cottell
3,881,459 A 5/1975 Gaetcke
3,892,070 A 7/1975 Bose
3,911,753 A 10/1975 Daub
3,973,532 A 8/1976 Litz
4,043,224 A 8/1977 Quick
4,046,028 A 9/1977 Vachris
4,077,429 A 3/1978 Kimball
4,127,332 A 11/1978 Thiruvengadam
4,128,388 A 12/1978 Freze
4,164,988 A 8/1979 Virva
4,182,282 A 1/1980 Pollet
4,185,597 A 1/1980 Cinquegrani
4,271,803 A * 6/1981 Nakanishi ..... F02B 23/08 123/193.4
4,300,499 A 11/1981 Nakanishi
4,312,305 A 1/1982 Noguchi
4,324,214 A * 4/1982 Garcea ..... F02B 23/08 123/193.6
4,331,118 A 5/1982 Cullinan
4,332,229 A 6/1982 Schuit
4,343,605 A 8/1982 Browning
4,357,916 A 11/1982 Noguchi
4,359,027 A * 11/1982 Scharpf ..... F02B 23/08 123/193.3
4,383,508 A 5/1983 Irimajiri
4,467,752 A 8/1984 Yunick
4,480,597 A 11/1984 Noguchi
4,488,866 A 12/1984 Schirmer
4,541,377 A * 9/1985 Amos ..... F02B 23/00 123/193.6
4,554,893 A 11/1985 Vecellio
4,570,589 A 2/1986 Fletcher
4,576,126 A 3/1986 Ancheta
4,592,318 A 6/1986 Pouring
4,597,342 A 7/1986 Green
4,598,687 A 7/1986 Hayashi
4,669,431 A * 6/1987 Simay ..... F02B 23/08 123/193.6
4,715,791 A 12/1987 Berlin
4,724,800 A 2/1988 Wood
4,756,674 A 7/1988 Miller
4,788,942 A 12/1988 Pouring
4,836,154 A 6/1989 Bergeron
4,874,310 A 10/1989 Seemann
4,879,974 A 11/1989 Alvers
4,919,611 A 4/1990 Flament
4,920,937 A * 5/1990 Sasaki ..... F02B 23/104 123/260
4,936,269 A 6/1990 Beaty
4,969,425 A 11/1990 Slee
4,990,074 A 2/1991 Nakagawa
4,995,349 A 2/1991 Tuckey
5,004,066 A 4/1991 Furukawa
5,007,392 A 4/1991 Niizato
5,020,504 A 6/1991 Morikawa
5,083,539 A 1/1992 Cornelio
5,154,141 A 10/1992 McWhorter
5,168,843 A 12/1992 Franks
5,213,074 A 5/1993 Imagawa
5,222,879 A 6/1993 Kapadia
5,251,817 A 10/1993 Ursic
5,343,618 A 9/1994 Arnold
5,357,919 A 10/1994 Ma
5,390,634 A * 2/1995 Walters ..... F02B 23/08 123/193.5
5,397,180 A 3/1995 Miller
5,398,645 A 3/1995 Haman
5,454,712 A 10/1995 Yap
5,464,331 A 11/1995 Sawyer
5,479,894 A 1/1996 Noltemeyer
5,660,532 A * 8/1997 Castel ..... F04B 9/1172 417/342
5,694,891 A 12/1997 Liebich
5,714,721 A 2/1998 Gawronski
5,779,461 A 7/1998 Iizuka
5,791,303 A 8/1998 Skripov
5,872,339 A 2/1999 Hanson
5,937,821 A 8/1999 Oda
5,957,096 A 9/1999 Clarke
6,003,488 A 12/1999 Roth
6,019,188 A 2/2000 Nevill
6,119,648 A 9/2000 Araki
6,138,616 A 10/2000 Svensson
6,138,639 A * 10/2000 Hiraya ..... F01L 3/06 123/295
6,199,369 B1 3/2001 Meyer
6,205,962 B1 3/2001 Berry, Jr.
6,237,164 B1 5/2001 LaFontaine
6,257,180 B1 7/2001 Klein
6,363,903 B1 4/2002 Hayashi
6,382,145 B2 5/2002 Matsuda
6,418,905 B1 7/2002 Baudlot
6,446,592 B1 9/2002 Wilksch
6,474,288 B1 11/2002 Blom
6,494,178 B1 12/2002 Cleary
6,508,210 B2 1/2003 Knowlton
6,508,226 B2 1/2003 Tanaka
6,536,420 B1 3/2003 Cheng
6,557,520 B2 * 5/2003 Roberts, Jr. ..... F02B 19/04 123/260
6,639,134 B2 10/2003 Schmidt
6,668,703 B2 12/2003 Gamble
6,682,313 B1 1/2004 Sulmone
6,691,932 B1 2/2004 Schultz
6,699,031 B2 3/2004 Kobayashi
6,705,281 B2 * 3/2004 Okamura ..... F02B 23/08 123/279
6,718,938 B2 4/2004 Szorenyi
6,758,170 B1 7/2004 Walden
6,769,390 B2 8/2004 Hattori
6,814,046 B1 11/2004 Hiraya
6,832,589 B2 12/2004 Kremer
6,834,626 B1 12/2004 Holmes
6,971,379 B2 * 12/2005 Sakai ..... F02B 23/08 123/661
6,973,908 B2 12/2005 Paro
7,074,992 B2 7/2006 Schmidt
7,150,609 B2 12/2006 Kiem
7,261,079 B2 8/2007 Gunji
7,296,545 B2 11/2007 Ellingsen, Jr.
7,341,040 B1 3/2008 Wiesen

(56) References Cited

U.S. PATENT DOCUMENTS

| | | | | |
|---|---|---|---|---|
| 7,360,531 | B2 | 4/2008 | Yohso | |
| 7,452,191 | B2 | 11/2008 | Tell | |
| 7,559,298 | B2 | 7/2009 | Cleeves | |
| 7,576,353 | B2 | 8/2009 | Diduck | |
| 7,584,820 | B2 | 9/2009 | Parker | |
| 7,628,606 | B1 | 12/2009 | Browning | |
| 7,634,980 | B2 | 12/2009 | Jarnland | |
| 7,717,701 | B2 | 5/2010 | D'Agostini | |
| 7,810,479 | B2 * | 10/2010 | Naquin | F02B 23/08 123/193.6 |
| 7,900,454 | B2 | 3/2011 | Schoell | |
| 7,984,684 | B2 | 7/2011 | Hinderks | |
| 8,037,862 | B1 | 10/2011 | Jacobs | |
| 8,215,292 | B2 | 7/2012 | Bryant | |
| 8,251,040 | B2 * | 8/2012 | Jang | F02B 23/104 123/276 |
| 8,284,977 | B2 | 10/2012 | Ong | |
| 8,347,843 | B1 | 1/2013 | Batiz-Vergara | |
| 8,385,568 | B2 | 2/2013 | Goel | |
| 8,479,871 | B2 | 7/2013 | Stewart | |
| 8,640,669 | B2 | 2/2014 | Nakazawa | |
| 8,656,870 | B2 | 2/2014 | Surnilla | |
| 8,714,135 | B2 | 5/2014 | Anderson | |
| 8,776,759 | B2 | 7/2014 | Cruz | |
| 8,800,527 | B2 | 8/2014 | McAlister | |
| 8,827,176 | B2 | 9/2014 | Browning | |
| 8,857,405 | B2 | 10/2014 | Attard | |
| 8,863,724 | B2 | 10/2014 | Shkolnik | |
| 8,919,321 | B2 | 12/2014 | Burgess | |
| 9,175,736 | B2 | 11/2015 | Greuel | |
| 9,289,874 | B1 | 3/2016 | Sabo | |
| 9,309,807 | B2 | 4/2016 | Burton | |
| 9,441,573 | B1 | 9/2016 | Sergin | |
| 9,512,779 | B2 | 12/2016 | Redon | |
| 9,736,585 | B2 | 8/2017 | Pattok | |
| 9,739,382 | B2 | 8/2017 | Laird | |
| 9,822,968 | B2 | 11/2017 | Tamura | |
| 9,854,353 | B2 | 12/2017 | Wang | |
| 9,938,927 | B2 * | 4/2018 | Ando | F02F 1/242 |
| 9,951,713 | B2 * | 4/2018 | Katakura | F02D 41/38 |
| 2002/0114484 | A1 | 8/2002 | Crisco | |
| 2002/0140101 | A1 | 10/2002 | Yang | |
| 2003/0111122 | A1 | 6/2003 | Horton | |
| 2005/0036896 | A1 | 2/2005 | Navarro | |
| 2005/0087166 | A1 | 4/2005 | Rein | |
| 2005/0155645 | A1 | 7/2005 | Freudendahl | |
| 2005/0257837 | A1 | 11/2005 | Bailey | |
| 2006/0230764 | A1 | 10/2006 | Schmotolocha | |
| 2007/0039584 | A1 | 2/2007 | Ellingsen, Jr. | |
| 2007/0101967 | A1 | 5/2007 | Pegg | |
| 2008/0169150 | A1 | 7/2008 | Kuo | |
| 2008/0184878 | A1 | 8/2008 | Chen | |
| 2008/0185062 | A1 | 8/2008 | Johannes Nijland | |
| 2010/0071640 | A1 | 3/2010 | Mustafa | |
| 2011/0030646 | A1 | 2/2011 | Barry | |
| 2011/0132309 | A1 | 6/2011 | Turner | |
| 2011/0139114 | A1 | 6/2011 | Nakazawa | |
| 2011/0235845 | A1 | 9/2011 | Wang | |
| 2012/0103302 | A1 | 5/2012 | Attard | |
| 2012/0114148 | A1 | 5/2012 | Goh Kong San | |
| 2012/0186561 | A1 | 7/2012 | Bethel | |
| 2013/0036999 | A1 * | 2/2013 | Levy | F02B 75/282 123/299 |
| 2013/0327039 | A1 | 12/2013 | Schenker et al. | |
| 2014/0056747 | A1 | 2/2014 | Kim | |
| 2014/0109864 | A1 | 4/2014 | Drachko | |
| 2014/0199837 | A1 | 7/2014 | Hung | |
| 2014/0361375 | A1 | 12/2014 | Deniz | |
| 2015/0059718 | A1 | 3/2015 | Claywell | |
| 2015/0153040 | A1 | 6/2015 | Rivera Garza | |
| 2015/0167536 | A1 * | 6/2015 | Toda | F02B 11/00 123/27 R |
| 2015/0184612 | A1 | 7/2015 | Takada et al. | |
| 2015/0337878 | A1 | 11/2015 | Schlosser | |
| 2015/0354570 | A1 | 12/2015 | Karoliussen | |
| 2016/0017839 | A1 | 1/2016 | Johnson | |
| 2016/0064518 | A1 | 3/2016 | Liu | |
| 2016/0258347 | A1 | 9/2016 | Riley | |
| 2016/0265416 | A1 | 9/2016 | Ge | |
| 2016/0348611 | A1 | 12/2016 | Suda et al. | |
| 2016/0348659 | A1 | 12/2016 | Pinkerton | |
| 2016/0356216 | A1 | 12/2016 | Klyza | |
| 2017/0248099 | A1 | 8/2017 | Wagner | |
| 2017/0260725 | A1 | 9/2017 | McAlpine | |
| 2018/0096934 | A1 | 4/2018 | Siew | |
| 2018/0130704 | A1 | 5/2018 | Li | |

FOREIGN PATENT DOCUMENTS

| | | |
|---|---|---|
| CN | 206131961 | 4/2017 |
| DE | 19724225 | 12/1998 |
| EP | 0025831 | 4/1981 |
| EP | 2574796 | 4/2013 |
| FR | 1408306 | 8/1965 |
| FR | 2714473 | 6/1995 |
| GB | 104331 | 1/1918 |
| GB | 139271 | 3/1920 |
| GB | 475179 | 11/1937 |
| GB | 854135 | 11/1960 |
| GB | 1437340 | 5/1976 |
| GB | 1504279 | 3/1978 |
| GB | 1511538 | 5/1978 |
| GB | 2140870 | 12/1984 |
| JP | S5377346 | 7/1978 |
| JP | S5833393 | 2/1983 |
| JP | 58170840 | 10/1983 |
| JP | S5973618 | 4/1984 |
| JP | H02211357 | 8/1990 |
| JP | H0638288 | 5/1994 |
| JP | 2000064905 | 3/2000 |
| JP | 2003065013 | 3/2003 |
| JP | 5535695 | 7/2014 |
| TW | 201221753 | 6/2012 |
| WO | 1983001485 | 4/1983 |
| WO | 2006046027 | 5/2006 |
| WO | 2007065976 | 6/2007 |
| WO | 2010118518 | 10/2010 |
| WO | 2016145247 | 9/2016 |

OTHER PUBLICATIONS

International Searching Authority Search Report and Written Opinion for application PCT/US2018/024102, dated Jun. 25, 2018, 10 pages.

International Searching Authority Search Report and Written Opinion for application PCT/US2018/024477, dated Jul. 20, 2018, 14 pages.

International Searching Authority Search Report and Written Opinion for application PCT/US2018/024485, dated Jun. 25, 2018, 16 pages.

International Searching Authority Search Report and Written Opinion for application PCT/US2018/024844, dated Jun. 8, 2018, 9 pages.

International Searching Authority Search Report and Written Opinion for application PCT/US2018/024852, dated Jun. 21, 2018, 9 pages.

International Searching Authority Search Report and Written Opinion for application PCT/US2018/025133, dated Jun. 28, 2018, 9 pages.

International Searching Authority Search Report and Written Opinion for application PCT/US2018/025151, dated Jun. 25, 2018, 14 pages.

International Searching Authority Search Report and Written Opinion for application PCT/US2018/025471, dated Jun. 21, 2018, 10 pages.

International Searching Authority Search Report and Written Opinion for application PCT/US2018/029947, dated Jul. 26, 2018, 12 pages.

International Searching Authority Search Report and Written Opinion for application PCT/US2018/030937, dated Jul. 9, 2018, 7 pages.

(56) References Cited

OTHER PUBLICATIONS

International Searching Authority Search Report and Written Opinion for application PCT/US2018/053264, dated Dec. 3, 2018, 10 pages.
International Searching Authority Search Report and Written Opinion for application PCT/US2018/053350, dated Dec. 4, 2018, 7 pages.
International Searching Authority Search Report and Written Opinion for application PCT/US2019/014936, dated Apr. 18, 2019, 9 pages.
International Searching Authority Search Report and Written Opinion for application PCT/US2019/015189, dated Mar. 25, 2019, 10 pages.
Keller, L. E., "Application of Trunk Piston Labyrinth Compressors in Refrigeration and Heat Pump Cycles" (1992). International Compressor Engineering Conference. Paper 859. http://docs.lib.purdue.edu/icec/859.
Quasiturbine Agence, "Theory—Quasiturbine Concept" [online], Mar. 5, 2005 (Mar. 5, 2005), retrieved from the internet on Jun. 29, 2018) URL:http://quasiturbine.promci.qc.ca/ETheoryQTConcept.htm; entire document.
Vetter, H., "The Sulzer Oil-Free Labyrinth Piston Compressor" (1972). International Compressor Engineering Conference. Paper 33. http://docs.lib.purdue.edu/icec/33.

* cited by examiner

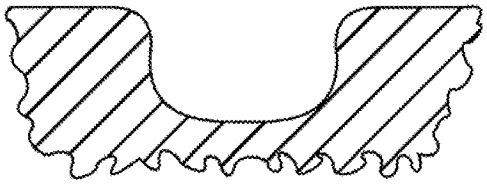
FIGURE 9A
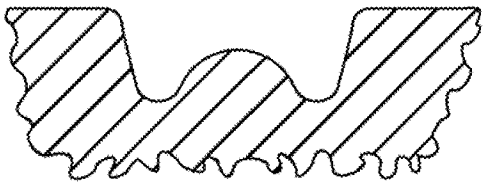
FIGURE 9B
FIGURE 9C
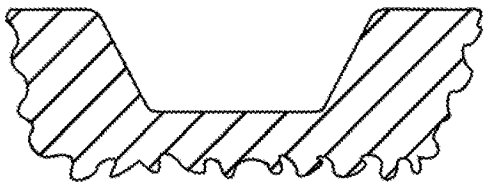
FIGURE 9D
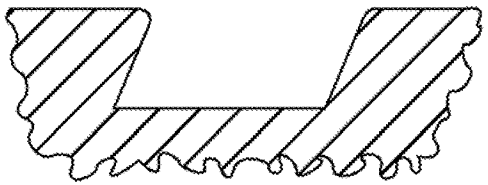
FIGURE 9E
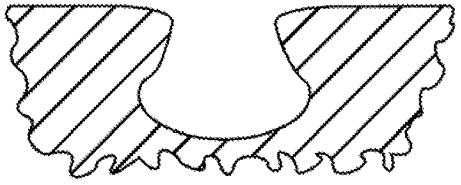
FIGURE 9F
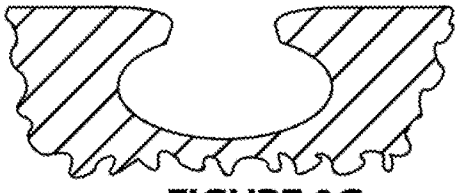
FIGURE 9G
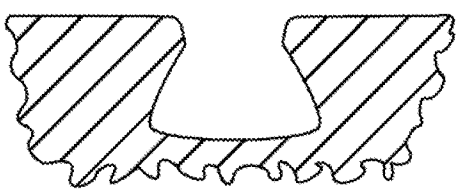
FIGURE 9H
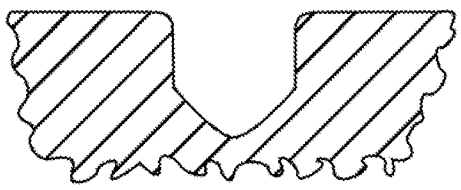
FIGURE 9I

INTERNAL COMBUSTION ENGINE HAVING PISTON WITH DEFLECTOR CHANNELS AND COMPLEMENTARY CYLINDER HEAD

CROSS REFERENCE TO RELATED APPLICATIONS

This application relates to and claims the priority of U.S. provisional patent application Ser. No. 62/479,013, which was filed Mar. 30, 2017.

FIELD OF THE INVENTION

The present invention relates generally to internal combustion engine pistons and methods of scavenging and exhausting gases in engine cylinders.

BACKGROUND OF THE INVENTION

Many internal combustion engines utilize cooperative engine cylinder and piston arrangements to generate power using a pumping motion. Engine cylinder and piston arrangements may be used to intake or scavenge an air-fuel mixture or strictly air charge (in fuel injected engines) for combustion and expel spent exhaust gases in multicycle operations, such as, for example, in 2-cycle and 4-cycle operations. While embodiments of the present invention have primary use for 2-cycle engine operation, the claims defining the invention are not limited to 2-cycle engines unless such limitation is expressly set forth in the claims.

Further, it is to be appreciated that the reference herein to an engine "cylinder" is not limited to a combustion chamber having a cylindrically shaped cross-section. Instead, the term cylinder refers to any combustion chamber or cavity provided in an internal combustion engine that receives a piston having an outer shape adapted to allow the piston to seal against the sidewall of the cylinder but at the same time permit the piston to slide back and forth reciprocally within the engine cylinder in a pumping motion.

In a fuel injected 2-cycle internal combustion engine, the engine cylinders may include one or more scavenging ports provided on the cylinder wall and one or more exhaust ports provided on the (usually opposite) side of the cylinder wall which permit gases to flow into, and out of, the engine cylinder, respectively. The pumping motion of the engine pistons may scavenge the air charge into the engine cylinder from the scavenging or intake port(s) for combustion and expel the spent charge exhaust gases generated from the previous combustion event through the exhaust port(s). In order to obtain efficient engine operation, the engine design, and specifically the engine piston and cylinder design, may minimize the flow of fresh, non-combusted air from the scavenging port(s) directly to the exhaust port(s). Improved engine efficiency may also result from an engine piston and cylinder design which: promotes swirl and turbulence in cylinder squish areas; permits central location of the spark plug, glow plug, water injector, and/or fuel injector over the piston in squish areas; and provides a shortened flame front propagation during combustion.

A known method of scavenging a two-cycle engine used a deflector structure or fin provided on the piston head to guide the incoming mixture as it entered the cylinder from a scavenging port. The deflector structure was provided to reduce the amount of the incoming charge that flowed across the cylinder head and out of the exhaust port before it was combusted. More specifically, the intended purpose of the deflector structure was to serve as a barrier to deflect the incoming charge upward away from the exhaust port in order to reduce the amount of incoming charge that escaped through the exhaust port before it was combusted.

Deflector structures on 2-cycle engine piston heads were replaced in many instances by flat piston heads that were required to obtain increased engine efficiency using higher compression ratios. The addition of known deflector structures limited the degree to which the piston could approach the upper cylinder wall, thereby limiting compression ratio. While a flat piston head permits higher compression ratio, it does not allow effective scavenging of the engine when compared with a traditional deflector or barrier fin based scavenging method; this is especially true in high compression diesel engines. Further, known deflector structures could create hot spots causing premature combustion of the charge and knocking. Such knocking can damage the engine in addition to causing further inefficiency by working against the advancing piston and the rotation of the crankshaft resulting in a definable loss of power.

OBJECTS OF THE INVENTION

Accordingly, it is an object of some, but not necessarily all embodiments of the present invention to provide engines, methods of engine manufacturing, and methods of engine operation that improve scavenging and/or reduce the amount of fresh charge lost through engine cylinder exhaust ports using cooperatively shaped piston heads and cylinder heads.

It is also an object of some, but not necessarily all embodiments of the present invention to provide engines, methods of engine manufacturing, and methods of engine operation that utilize cooperative engine piston head and cylinder shapes that include an upper surface that is non-flat and preferably curved or domed and more preferably semi-hemispherical.

It is also an object of some, but not necessarily all embodiments of the present invention to provide engines, methods of engine manufacturing, and methods of engine operation that use improved deflector structures and/or engine cylinder shapes which permit generation of needed engine cylinder compression ratios.

It is also an object of some, but not necessarily all embodiments of the present invention to provide engines, methods of engine manufacturing, and methods of engine operation that reduce hot spots and engine knocking that would otherwise result from use of a piston head deflector structure.

It is also an object of some, but not necessarily all embodiments of the present invention to provide engines, methods of engine manufacturing, and methods of engine operation that compress charged gases from opposite concave sides of a piston so that they converge near the center of the piston head.

It is also an object of some, but not necessarily all embodiments of the present invention to provide engines, methods of engine manufacturing, and methods of engine operation which promote swirl and turbulence in the engine cylinder.

It is also an object of some, but not necessarily all, embodiments of the present invention to provide engines, methods of engine manufacturing, and methods of engine operation that permit a spark plug, glow plug, water injector, and/or fuel injector to be centrally located over the piston in an area of squish and/or turbulence.

It is also an object of some, but not necessarily all, embodiments of the present invention to provide engines, methods of engine manufacturing, and methods of engine operation that promote an optimal and/or shortened flame front propagation during combustion.

It is also an object of some, but not necessarily all, embodiments of the present invention to provide engines, methods of engine manufacturing, and methods of engine operation that permit fuel injection to occur around piston top dead center position and which may promote optimal compressed charge and reduced unspent fuel loss through the exhaust port during scavenging.

It is also an object of some, but not necessarily all, embodiments of the present invention to provide engines, methods of engine manufacturing, and methods of engine operation that utilize sloped concave channels on the piston head to guide incoming charged gases outward over the sides of the engine piston head and upward away from the intake or scavenging port.

It is also an object of some, but not necessarily all embodiments of the present invention to provide engines, methods of engine manufacturing, and methods of engine operation that guide an incoming charge so that it is urged upward against an inclined radius of the cylinder wall so as to drive spent exhaust gases lower in the combustion chamber and into the exhaust port(s).

These and other advantages of some, but not necessarily all, embodiments of the present invention will be apparent to those of ordinary skill in the art.

SUMMARY OF THE INVENTION

Responsive to the foregoing challenges, Applicant has developed an innovative internal combustion engine comprising: an engine cylinder having an intake port and an exhaust port; a piston disposed in said engine cylinder, said piston having a lower skirt and an upper dome; first and second diametrically opposed and identical concave channels formed on the piston upper dome; and a concave downward sloped channel formed on the upper dome, wherein the first and second diametrically opposed and identical concave channels are proximal to the intake port relative to a first reference plane that is equidistant at all points from the exhaust port and the intake port, wherein the first and second diametrically opposed and identical concave channels are equally spaced from a second reference plane that is perpendicular to the first reference plane, and wherein the concave downward sloped channel is proximal to the exhaust port relative to the first reference plane and longitudinally bisected by the second reference plane.

Applicant has further developed an innovative internal combustion engine comprising: an engine cylinder; an engine cylinder head having an intake port substantially diametrically opposite to an exhaust port; a piston disposed in said engine cylinder, said piston having a lower skirt portion and an upper domed portion, said upper domed portion proximal to the engine cylinder head and terminating at an upper-most point at an apex; first and second channels formed in said upper domed portion in relative proximity to the intake port as compared to the exhaust port, and formed on respective first and second sides of the upper domed portion, wherein said first and second sides of the upper domed portion are defined by a reference plane that extends between the intake port and the exhaust port and that bisects the upper domed portion; and a third channel formed in said upper domed portion between the first and second channels, and formed in relative proximity to the exhaust port as compared with the intake port.

Applicant has still further developed an innovative internal combustion engine piston comprising: a lower skirt; an upper dome having an apex; first and second diametrically opposed and concave channels formed on the upper dome below the apex; and a concave downward sloped channel formed on the upper dome between the first and second diametrically opposed concave channels, wherein the first and second diametrically opposed and concave channels are equally spaced from a first reference plane that is coextensive with a reference center axis for the piston skirt, and off-center relative to a second reference plane that is perpendicular to the first reference plane and coextensive with the reference center axis for the piston skirt, and wherein the concave downward sloped channel is centered relative to the first reference plane, and off-center relative to the second reference plane.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements. The drawings are exemplary only, and should not be construed as limiting the invention.

FIGS. 9A-9J are cross-sectional views of example exhaust channels and inlet channels shaped in accordance with alternative embodiments of the present invention.

DETAILED DESCRIPTION OF EMBODIMENTS OF THE INVENTION

Figure 1:
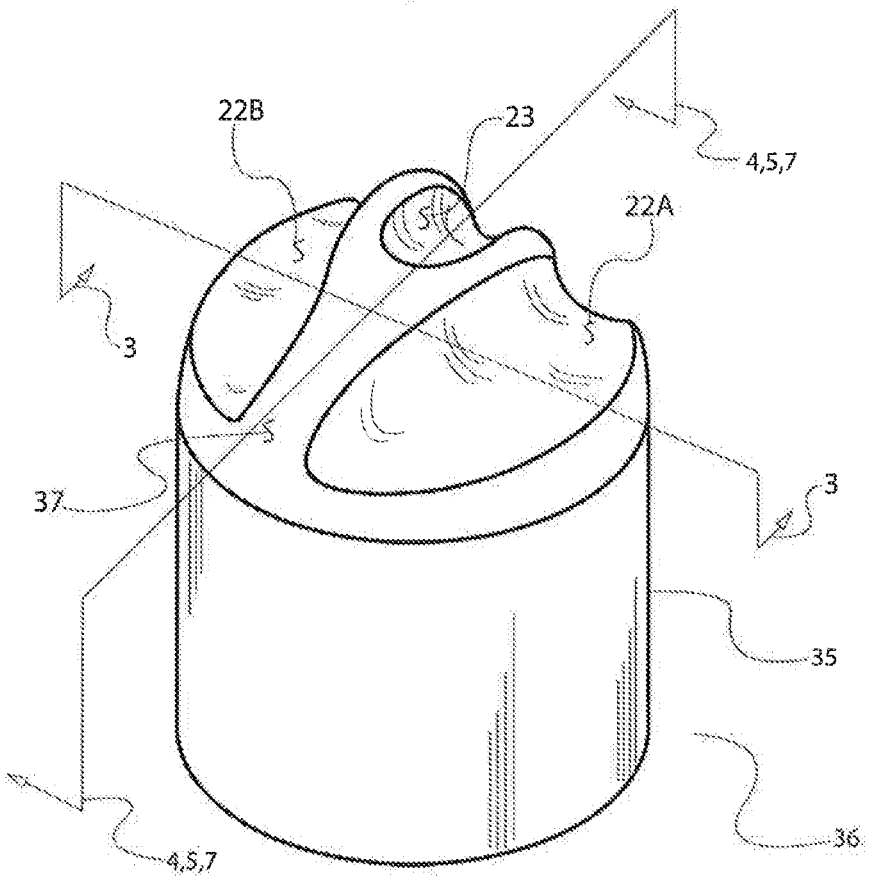
FIG. 1 is an isometric view of a piston shaped in accordance with a first embodiment of the present invention from the domed head and intake side.

Reference will now be made in detail to embodiments of the present invention, examples of which are illustrated in the accompanying drawings. With reference to FIGS. 1-7, in a first embodiment of the invention, a cooperatively shaped piston 36 and surrounding cylinder 38 are illustrated.

The engine cylinder 38 and piston 36 may define an engine combustion chamber 21 that communicates with an intake port 26 and an exhaust port 27. The intake port 26 and the exhaust port 27 are preferably diametrically opposed. The piston 36 may include a generally centrally located upper dome or projection 37 and a lower piston skirt 35. The piston skirt 35 and engine cylinder 38 may be generally cylindrical, and the piston skirt 35, engine cylinder 38, and the upper dome 37 may have a circular cross-section as is apparent from FIG. 6.

The curvature of the outer surface of the upper dome 37 may be preferably hemispherical or semi-hemispherical, and may have a substantially constant radius of curvature. The upper dome 37 may extend between diametrically opposed edges of the piston skirt 35, and thus the diameters of the piston skirt 35 and the upper dome 37 may be substantially the same. The upper dome 37 may have an upper-most crown or apex that may be located at a point spaced from or coincident with a reference axial centerline extending through the centers of the upper dome and piston skirt 35 in the direction of the exhaust port 27. In other words, the apex may be off-center and proximal to the exhaust port 27 of an engine cylinder in which the piston 38 is disposed relative to a first reference plane that is equidistant at all points from the exhaust port and the intake port, or may be on-center and intersect with the first reference plane.

Figure 2:
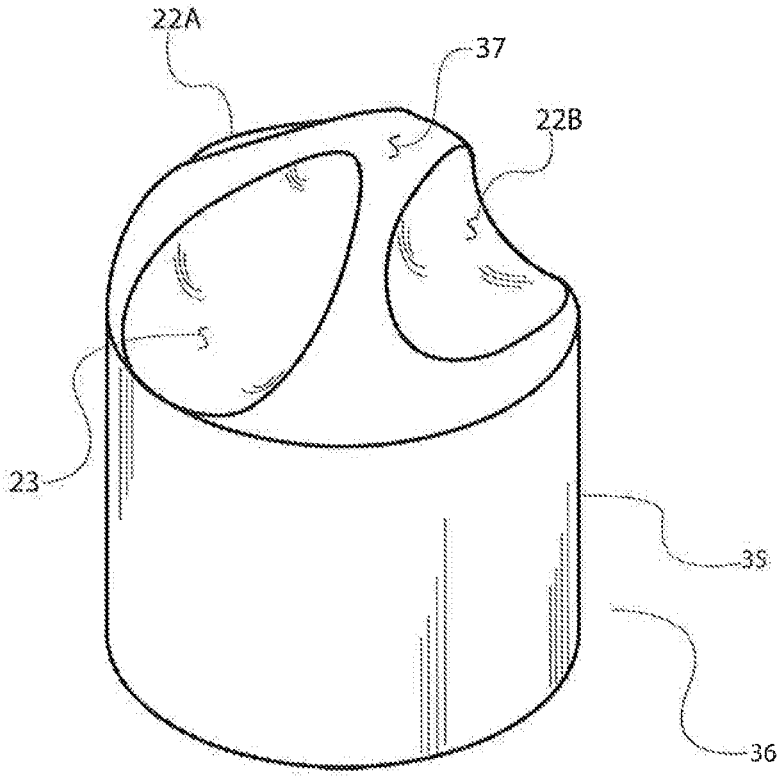
FIG. 2 is an isometric view of the piston of FIG. 1 from the exhaust side, rotated 180° from FIG. 1, wherein the piston is shaped in accordance with the first embodiment of the present invention.

A concave downward sloped exhaust channel 23 may extend through a central portion of the upper dome 37. The exhaust channel 23 may terminate at an upper most location at or near (i.e., just before or just after) the apex of the upper dome 37. In FIG. 2, for example, the exhaust channel 23 extends from about the interface of the piston skirt 35 and upper dome 37 at a lower portion of the exhaust channel to a location just short of the apex of the upper dome at an upper portion of the exhaust channel. In other words, the exhaust channel 23 may be formed entirely on one side of the first reference plane proximal to the exhaust port 27. The exhaust channel 23 may include a compound curved shape, curved in both a first longitudinal piston-skirt-to-piston-apex direction and in a second direction perpendicular to the first longitudinal piston-skirt-to-piston-apex direction. The concave downward sloped exhaust channel 23 may be formed with an end-to-end length (taken in the longitudinal piston-skirt-to-piston-apex direction) that is greater than a maximum side-to-side width (taken in a direction perpendicular to the first longitudinal piston-skirt-to-piston-apex direction).

It is appreciated that in alternative embodiments the exhaust channel 23 may extend from a lower location starting further above the interface of the piston skirt 35 and upper dome 37 and/or to a location at or even slightly beyond the apex of the upper dome. It is also appreciated that the curvature of exhaust channel 23 in the first longitudinal piston-skirt-to-piston-apex direction and/or in the second direction perpendicular to the first longitudinal piston-skirt-to-piston-apex direction may vary to some degree without departing from the intended scope of the present invention so long as the overall shape promotes exhaust gas flow needed for engine operation.

The piston 36 may further include two symmetrical (i.e., identical) and diametrically opposed gently curved concave inlet channels 22A and 22B extending along either side of the exhaust channel 23 on the upper dome 37 of the piston 36. The inlet channels 22A and 22B may extend generally circumferentially from end to end over a minority portion, or more preferably a majority portion, of the circumference of the piston skirt 35 and upper dome 37 interface. In other words, the two concave inlet channels 22A and 22B may extend from locations proximal to the intake port 26 towards the exhaust port 27 past the first reference plane. The inlet channels 22A and 22B may each include a matching compound curved shape, curved in both a first piston circumferential direction and in a second piston-skirt-to-piston-apex direction. The curvatures of the inlet channels 22A and 22B in both of these directions may vary to some degree without departing from the intended scope of the present invention so long as the overall shapes promote intake gas flow needed for engine operation.

The position of the concave downward sloped exhaust channel 23 and the inlet channels 22A and 22B relative to the each other and relative to the intake port 26 and exhaust port 27 can vary to some degree. Generally it is preferred that the inlet channels 22A and 22B be proximal to the intake port 26 relative to a first reference plane that is equidistant at all points from the exhaust port 27 and the intake port 26, and that the exhaust channel 23 be proximal to the intake port 26 relative to the first reference plane. It is also preferred that the inlet channels 22A and 22B be equally spaced from a second reference plane that is perpendicular to the first reference plane, extends between the intake port 26 and the exhaust port 27, and bisects the piston lower skirt 35 and upper dome 37. The second reference plane may be coextensive with a reference center axis for the piston skirt, and the inlet channels 22A and 22B may be spaced from and thus off-center relative to the second reference plane. The exhaust channel 23 may be centered relative to the second reference plane, and off-center relative to the first reference plane. In some embodiments, the exhaust channel 23 may have an upper-most lip above the inlet channels 22A and 22B relative to an upper dome 37 apex when the piston 36 is viewed from the side, such as in FIGS. 3 and 5.

The piston 36 may be slidably disposed in an engine cylinder 38 including at its upper end a cylinder head. The interior surface of the cylinder head may be formed in a negative image or complementary to the shape of the upper dome 37. The combustion chamber 21 is defined by the space between the cylinder head and the upper dome 37. When the upper dome 37 of the piston 36 is hemispherical or semi-hemispherical, the upper end of the combustion chamber 21 may also be hemispherical or semi-hemispherical.

Figure 3:
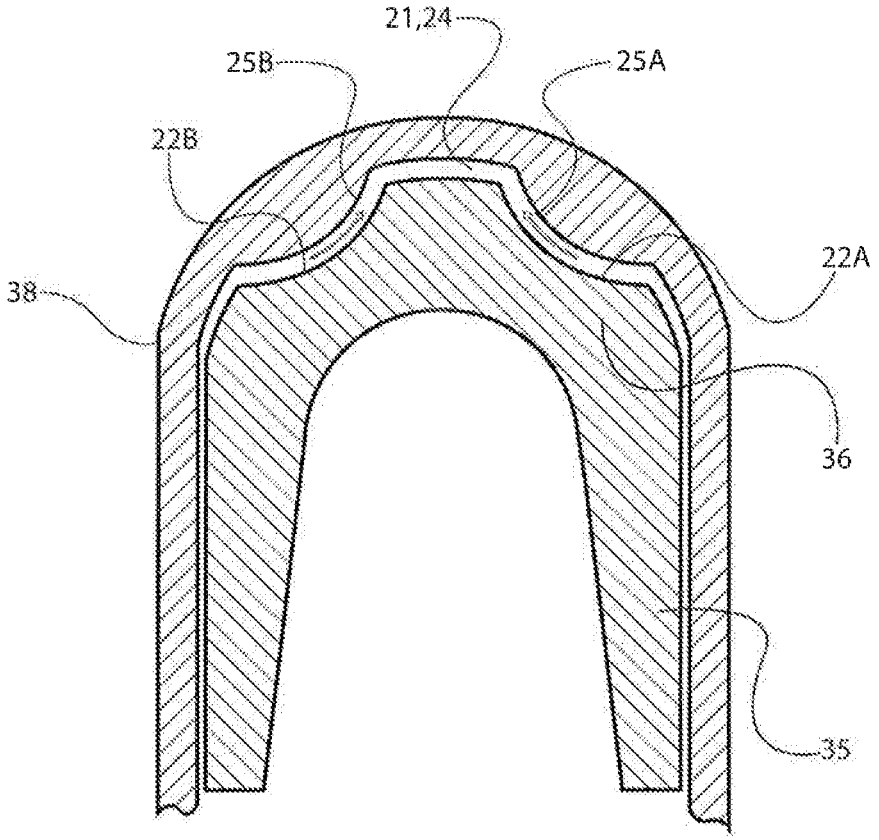
FIG. 3 is a cross-section of the piston of FIG. 1 taken through cut line 3-3 further including a cross-section of a cylinder wall surrounding the piston, wherein the piston and cylinder are shaped in accordance with the first embodiment of the present invention.
Figure 4:
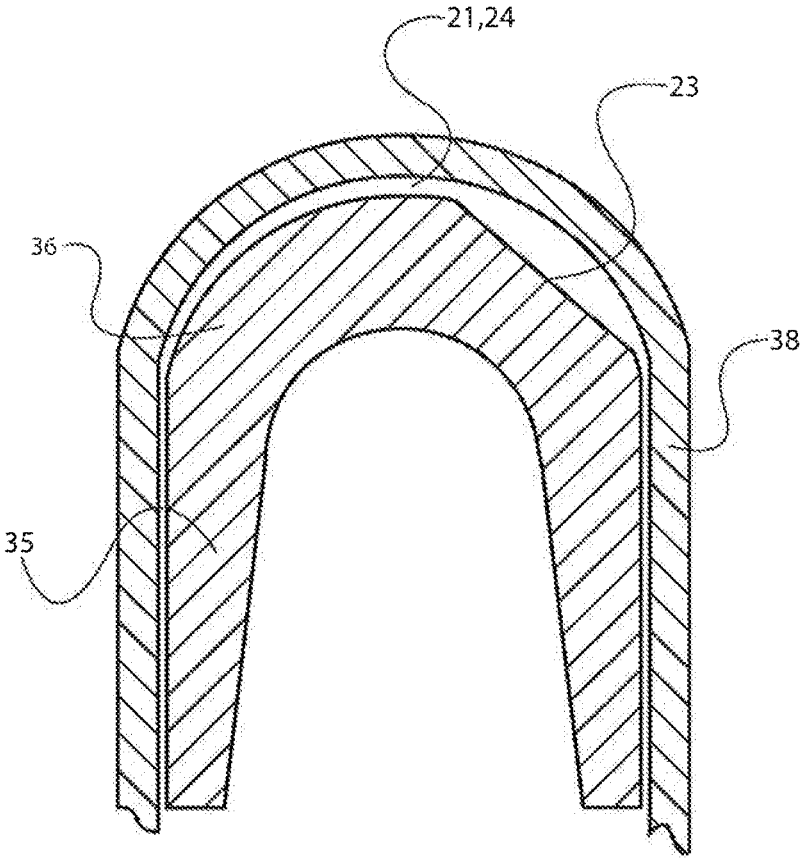
FIG. 4 is a cross-section of the piston of FIG. 1 taken through cut line 4-4 further including a cross-section of a cylinder wall surrounding the piston (without illustration of scavenging port, exhaust port, spark plug or fuel injector), wherein the piston and cylinder are shaped in accordance with the first embodiment of the present invention.
Figure 7:
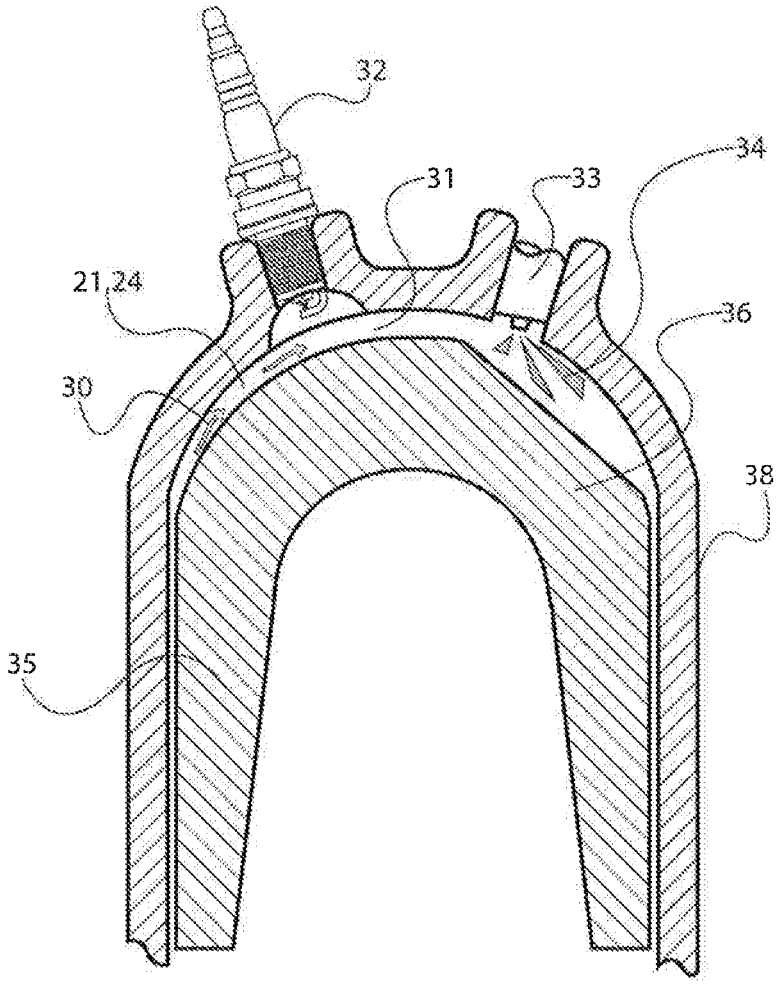
FIG. 7 is cross-section of the piston of FIG. 1 taken through cut line 7-7 further including a cross-section of a cylinder wall surrounding the piston (without illustration of scavenging port or exhaust port), wherein the piston and cylinder are shaped in accordance with the first embodiment of the present invention.

With reference to FIGS. 3 and 4, for example, the upper portion of the cylinder 38 which defines the combustion chamber 21 (which may coincide with the cylinder head) may include inner walls with curved surfaces that are exact or close inverse counterparts to the curved surfaces of all or part of the domed head 37, the exhaust channel 23, and the inlet channels 22A and 22B. With reference to FIG. 3, the curvatures of the portion of the combustion chamber 21 that oppose the curvatures of the inlet channels 22A and 22B may closely match each other. With reference to FIG. 4, the curvature of the portion of the combustion chamber 21 that opposes the curvature of the exhaust channel 23 may depart from each other gradually with the greatest departure in shape occurring at the center of the exhaust channel. With reference to FIG. 7, the placement of a spark plug 32, glow plug (not shown), water injector (not shown), and/or a fuel injector 33 may be located centrally over the piston 36 in the cylinder.

Figure 5:
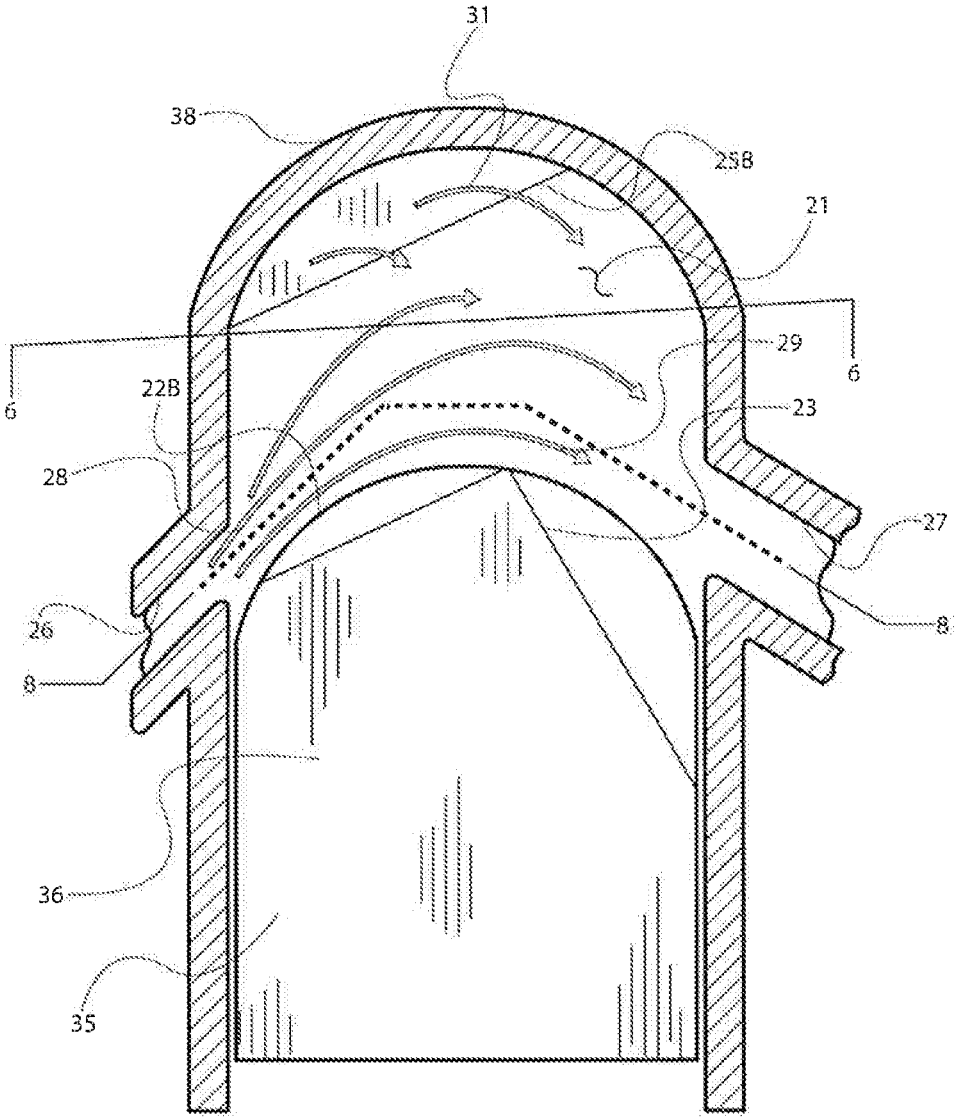
FIG. 5 is a cross-section of the piston of FIG. 1 taken through cut line 5-5 further including a cross-section of a cylinder wall surrounding the piston (with illustration of scavenging port, exhaust port, spark plug and fuel injector), wherein the piston and cylinder are shaped in accordance with the first embodiment of the present invention.
Figure 6:
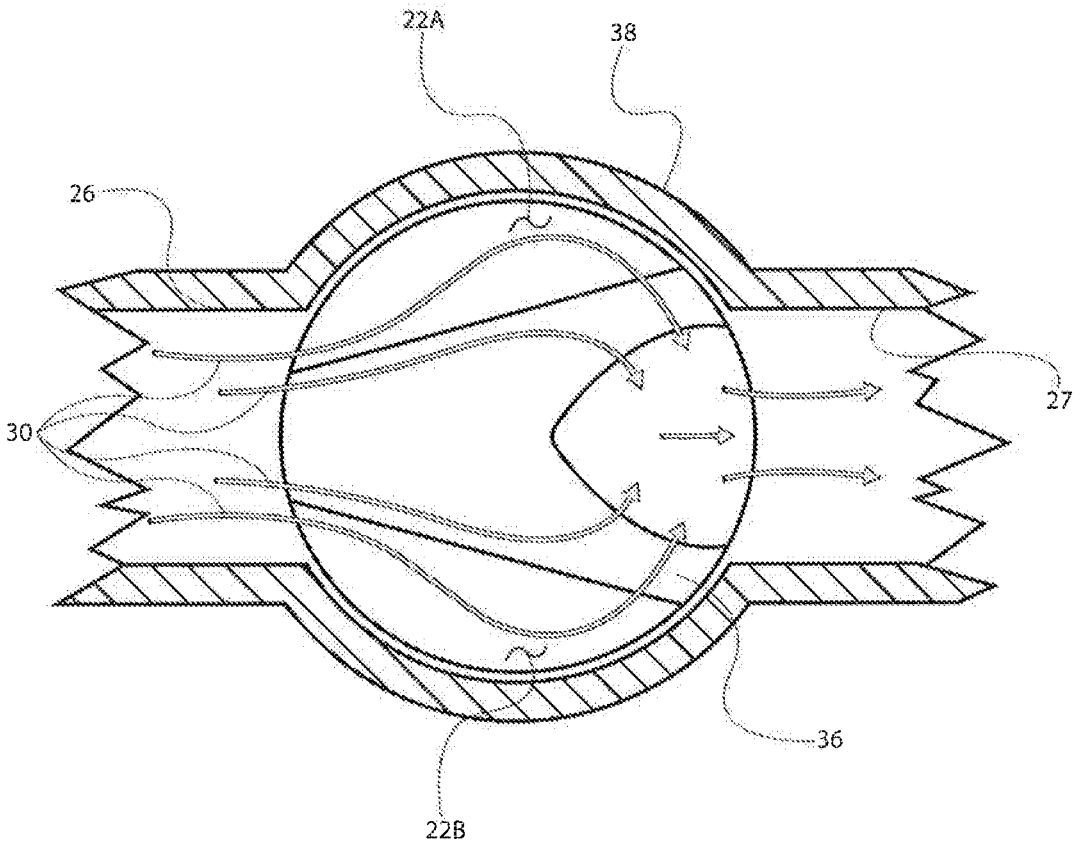
FIG. 6 is a top plan view of the cylinder and piston of FIG. 5 taken through cut line 6-6, wherein the piston and cylinder are shaped in accordance with the first embodiment of the present invention.

With reference to FIGS. 5 and 6, the scavenging and exhaust flow of gases are illustrated in the engine combustion chamber 21 between an intake port 26 and an exhaust port 27. Improved squish of intake gases may be accomplished using the piston 36 with two concave inlet channels 22A and 22B, a piston projection upper dome 37, and a downward sloping concave exhaust channel 23, all located above the piston skirt 35. With reference to FIGS. 5 and 6, the incoming charge 28 and 29 may be directed along line 8-8 from the intake port 26 to the exhaust port 27. This flow may create flow lines in the squish areas 30 and 31 between the piston concave channels 22A and 22B and the inward curved projections on 25A and 25B on the cylinder 38 walls, thereby inducing scavenging of the chamber. With reference to FIG. 7, as the piston 36 rises above bottom dead center and proceeds toward top dead center, turbulence may be induced as the charge is forced into the compression area 24 where the spark plug 32 is allowed to come into intimate contact with the compressed charge. The direct fuel injector 33 may be oriented to direct the fuel injector spray 34 towards and/or into the exhaust channel 23. This may promote a more uniform flame front travel and subsequent faster flame front travel.

Figure 8:
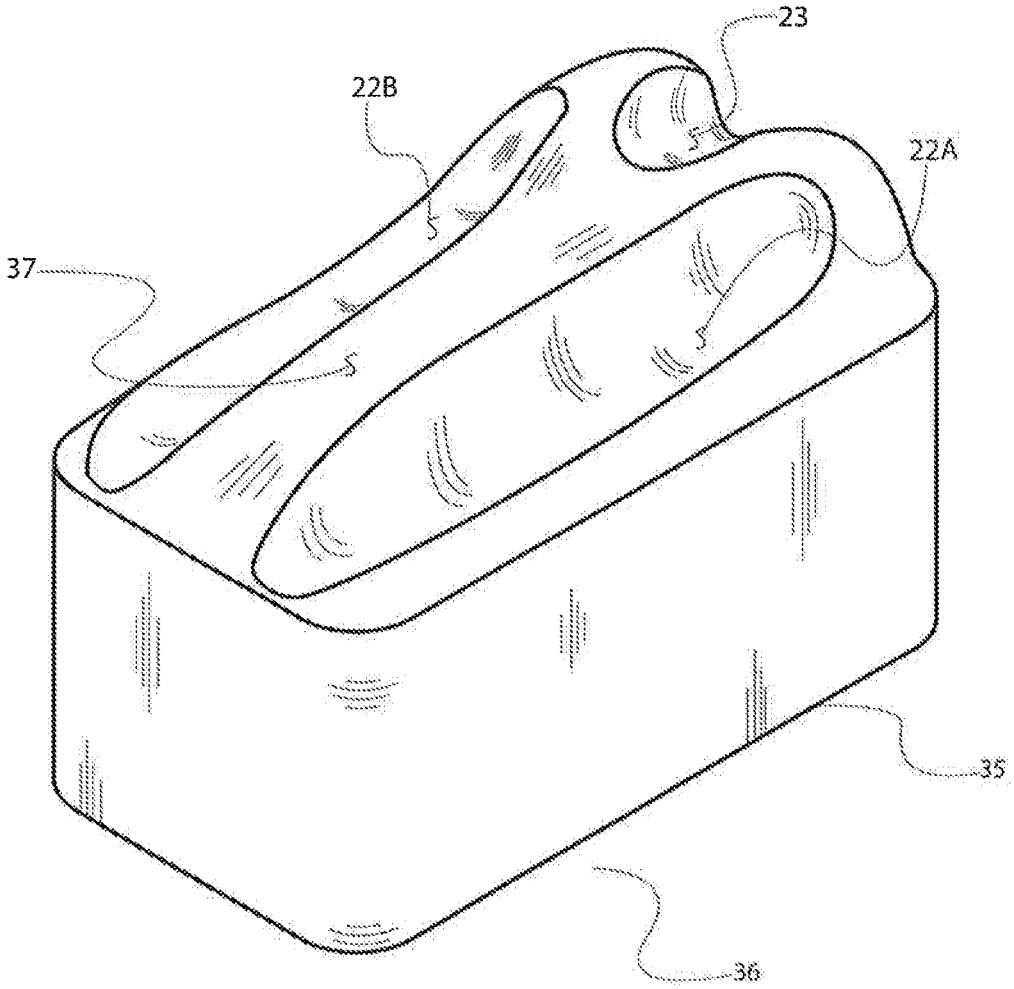
FIG. 8 is an isometric view of a rectangular variant of a piston shaped in accordance with a second embodiment of the present invention from the upper dome and intake side.

With reference to FIG. 8, in a second embodiment of the present invention, the piston skirt 35 and the upper dome 37 of the piston 36 may have a generally rectangular cross-section with rounded corners. The upper dome 37 may have an apex that is off-center and proximal to the exhaust port of an engine cylinder (not shown) in which the piston is disposed relative to a first reference plane that is equidistant at all points from the exhaust port and the intake port of the surrounding engine cylinder. The exhaust channel 23 may be formed entirely on one side of the first reference plane proximal to the exhaust port, while the two concave inlet channels 22A and 22B may extend from locations proximal to the intake port towards the exhaust port past the first reference plane.

Figure 10:
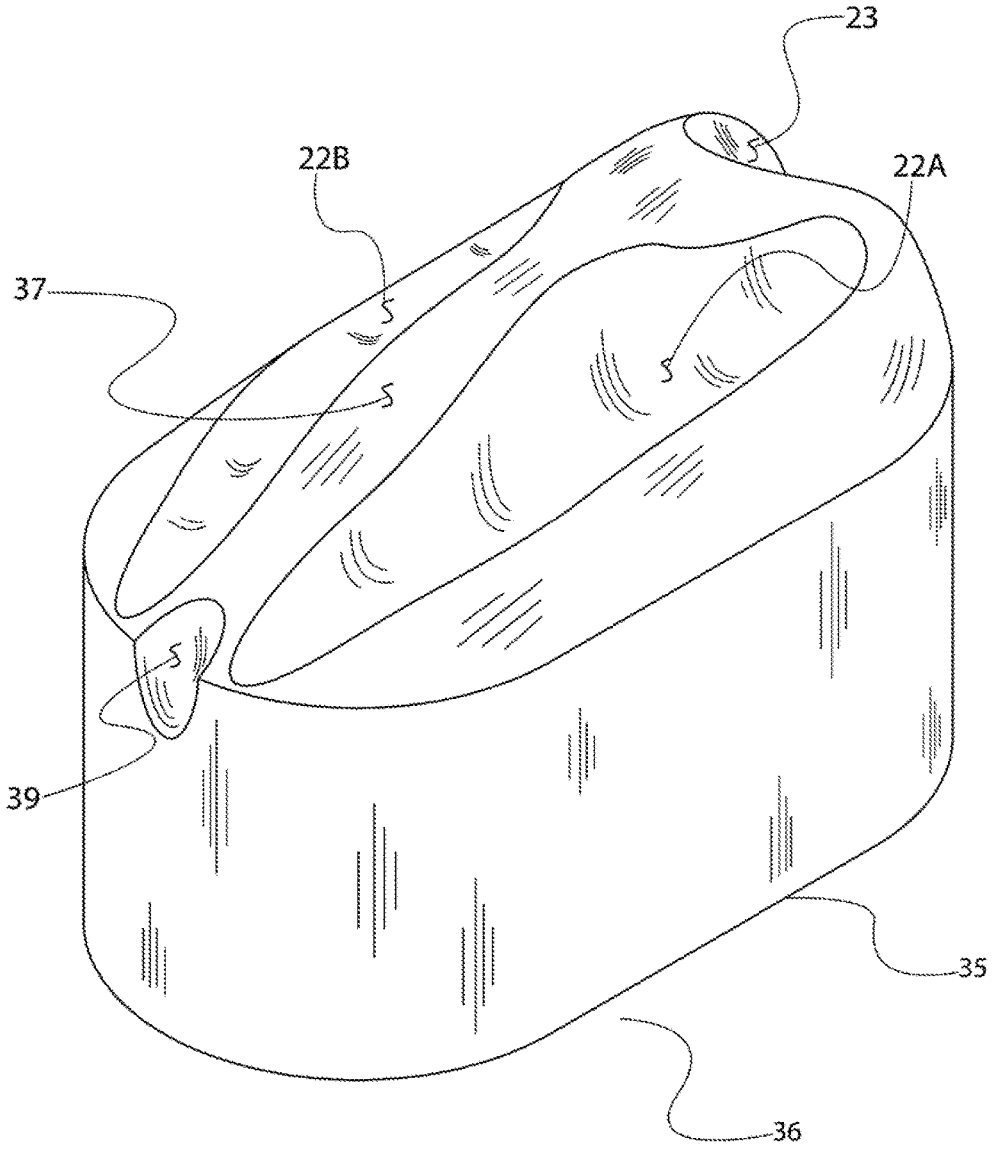
FIG. 10 is an isometric view of an ovular variant of a piston shaped in accordance with a third embodiment of the present invention from the upper dome and intake side which includes a third inlet channel.

With reference to FIG. 10, in a third embodiment of the present invention, the piston skirt 35 and the upper dome 37 of the piston 36 may have a generally ovular cross-section. A third concave inlet channel 39 may be provided between the two inlet channels 22A and 22B at the intersection of the piston skirt 35 and the upper dome 37. The third concave inlet channel 39 may be bisected by a reference plane extending between, and spaced an equal distance from, each of the two inlet channels 22A and 22B. The third concave inlet channel 39 may extend across the junction of the piston skirt and the upper dome 37, and may be considerably smaller in length and maximum width than the two concave inlet channels 22A and 22B. The third concave inlet channel 39 may be elongated in a direction parallel to a reference plane extending between, and spaced an equal distance from, each of the two inlet channels 22A and 22B. The cross-sectional shape of the third concave inlet channel 39 may be smoothly curved in both the elongated direction and from side-to-side perpendicular to the elongated direction. In alternate embodiments, the length, width, depth and cross-sectional shape of the third concave inlet channel 39 may vary.

The channel shapes illustrated in FIGS. 1-8 and 10 may create a two axis swirling movement of inlet gases in particular. More specifically, the channel shapes of FIGS. 1-8 and 10 may create a tubular shaped first axis of swirl extending along the length of the inlet channels 22A and 22B. This first swirl may be pronounced during piston rising and tend to scrub along the piston walls and radiate upwards. The channel shapes of FIGS. 1-8 and 10 may also create a second swirl movement having a curved axis extending from the inlet channels 22A and 22B near the channel ends proximal to the exhaust port along a reference plane set approximately 30 to 45 degrees from a reference plane that extends between the exhaust port and the intake port.

Figure 9J:
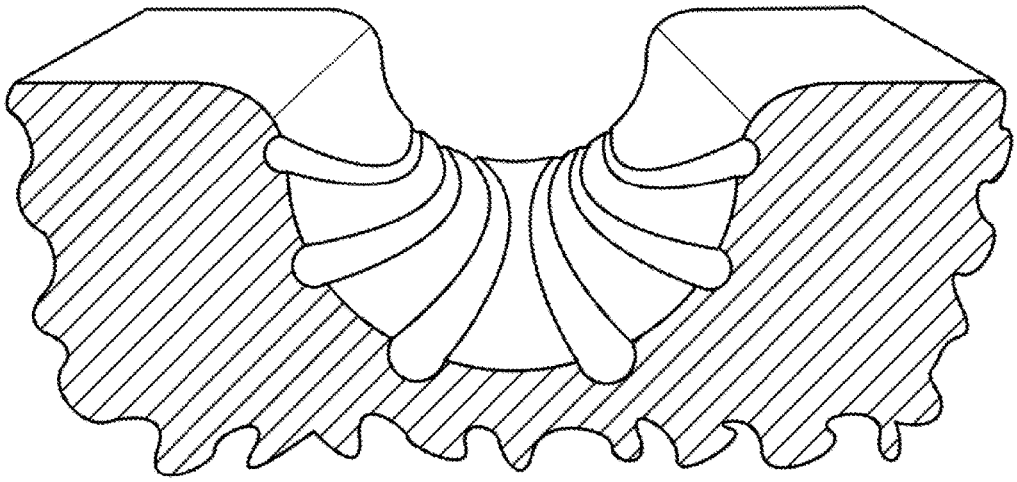

With reference to FIGS. 9A-9J, the inlet channels 22A, 22B and 39, and the exhaust channel 23, may have a: semi-circular (FIG. 9A), ribbed multi-curved surface (9B), round edged rectangular (9C), trapezoidal (9D), parallelogramic or rhombic (9E), oval (9F), elliptical (9G), triangular 9(H), polygonal (9I), or grooved (9J) cross-sectional shape. With reference to FIG. 9J, the grooves may extend parallel to the channel central axis, or in a converging, diverging or twisted pattern.

The cross-sectional channel shapes illustrated in FIGS. 9A-9J may create one or more additional axis of swirl of inlet (and possibly exhaust) gases as the piston 36 moves in the engine cylinder 38. The grooves shown in FIG. 9J may provide a spreading or condensing action to the swirl motion or may provide a tumbling about the axes of movement providing stronger coherence of the cylinder gases to the swirling motion(s). The channel geometries illustrated in FIGS. 9A-9J may also change swirl orientation from what it would otherwise be, and change the coherence of the previously discussed axes of swirl. In alternative embodiments of the invention, the inlet channels 22A and 22B may have different channel cross-sectional shapes or sizes to create an upward helical flow of gases in the engine cylinder.

As will be understood by those skilled in the art, the invention may be embodied in other specific forms without departing from the spirit or essential characteristics thereof. The elements described above are illustrative examples of one technique for implementing the invention. One skilled in the art will recognize that many other implementations are possible without departing from the intended scope of the present invention as recited in the claims. For example, the curvatures of the domed surface of the piston head and cooperative cylinder head may vary without departing from the intended scope of the invention. Further, the shapes, sizes, and curvatures of each of the individual channels provided in the domed surface of the piston head may vary without departing from the intended scope of the invention. Still further, embodiments of the invention may be used in engines that are 2-cycle, 4-cycle, or multi-cycle, and that utilize any type of fuel, such as gasoline, bio-gasoline, natural gas, propane, alcohol, bio-alcohol, diesel, bio-diesel, hydrogen, gasified carbonaceous, bio-mass, or blended fuels. Accordingly, the disclosure of the present invention is intended to be illustrative, but not limiting, of the scope of the invention. It is intended that the present invention cover all such modifications and variations of the invention, provided they come within the scope of the appended claims and their equivalents.

What is claimed is:

1. An internal combustion engine comprising:

an engine cylinder having an intake port and an exhaust port;

a piston disposed in said engine cylinder, said piston having a lower skirt and an upper dome;

first and second diametrically opposed and identical concave channels formed on the piston upper dome;

a concave downward sloped channel formed on the upper dome, wherein the first and second diametrically opposed and identical concave channels are proximal to the intake port relative to a first reference plane that is equidistant at all points from the exhaust port and the intake port; and a domed cylinder head surrounding an upper portion of the piston with clearance for compression volume when the piston is at a top dead center position, said domed cylinder head having an inner wall shape that is substantially a negative image of said piston upper dome including the first and second diametrically opposed and identical concave channels and the concave downward sloped channel, wherein the first and second diametrically opposed and identical concave channels are equally spaced from a second reference plane that is perpendicular to the first reference plane, and wherein the concave downward sloped channel is proximal to the exhaust port relative to the first reference plane and longitudinally bisected by the second reference plane.

2. The internal combustion engine of claim 1, wherein the piston lower skirt and upper dome each have a diameter that are substantially the same.

3. The internal combustion engine of claim 1, wherein the upper dome has a diametrical curved surface with a substantially constant radius of curvature disregarding the first and second diametrically opposed and identical concave channels and disregarding the concave downward sloped channel.

4. The internal combustion engine of claim 1, wherein the concave downward sloped channel is formed on the upper dome to extend between the first and second diametrically opposed and identical concave channels.

5. The internal combustion engine of claim 1, wherein the concave downward sloped channel has an upper-most lip disposed above the first and second diametrically opposed and identical concave channels proximal to an apex of the upper dome.

6. The internal combustion engine of claim 1, wherein the concave downward sloped channel is formed with an end-to-end length greater than a maximum side-to-side width.

7. The internal combustion engine of claim 1, wherein said concave downward sloped channel formed on the upper dome has a downward slope that is substantially a negative image of said domed cylinder head surrounding the piston.

8. The internal combustion engine of claim 7, wherein the domed cylinder head is configured to urge exhaust gases toward the exhaust port when the piston is moving away from a bottom dead center position.

9. The internal combustion engine of claim 7, further comprising an engine component port located at or near a center of said domed cylinder head, said engine component port selected from the group consisting of: a spark plug port, a glow plug port, a fuel injector port, and a water injector port.

10. The internal combustion engine of claim 1, wherein said first and second diametrically opposed and identical concave channels are configured to urge intake gases upward toward the domed cylinder head and the concave downward sloped channel is configured to urge exhaust gases toward the exhaust port when the piston is moving away from a bottom dead center position.

11. The internal combustion engine of claim 1, wherein said piston skirt has peripheral shape that is selected from the group consisting of: circular, rectangular, and ovular.

12. The internal combustion engine of claim 1, further comprising:

an additional concave channel formed on the upper dome proximal to the intake port relative to the first reference plane and longitudinally bisected by the second reference plane.

13. The internal combustion engine of claim 12, wherein the additional concave channel extends across a junction of the upper dome and piston skirt.

14. An internal combustion engine comprising:

an engine cylinder;

an engine cylinder head having an intake port substantially diametrically opposite to an exhaust port;

a piston disposed in said engine cylinder, said piston having a lower skirt portion and an upper domed portion, said upper domed portion proximal to the engine cylinder head and terminating at an upper-most point at an apex;

first and second channels formed in said upper domed portion in relative proximity to the intake port as compared to the exhaust port, and formed on respective first and second sides of the upper domed portion, wherein said first and second sides of the upper domed portion are defined by a reference plane that extends between the intake port and the exhaust port and that bisects the upper domed portion; and a third channel formed in said upper domed portion between the first and second channels, and formed in relative proximity to the exhaust port as compared with the intake port, and wherein the engine cylinder head has a complementary and negative shape to that of the upper domed portion including the first, second and third channels.

15. The internal combustion engine of claim 14, wherein the first and second channels are curved concave channels extending along either side of the third channel.

16. The internal combustion engine of claim 14, wherein the first and second channels extend generally circumferentially form end to end over a minority portion of the upper domed portion.

17. The internal combustion engine of claim 14, wherein the first and second channels extend generally circumferentially form end to end over a majority portion of the upper domed portion.

18. The internal combustion engine of claim 14, wherein the first and second channels each include a matching compound curved shape, curved in both a first piston circumferential direction and in a second piston-to-skirt-to-piston-apex direction.

19. The internal combustion engine of claim 14, wherein the apex is proximal to the exhaust port relative to the intake port.

20. The internal combustion engine of claim 14, further comprising:

an additional concave channel formed on the upper dome proximal to the intake port and longitudinally bisected by the reference plane.

* * * * *